US011613410B2

(12) United States Patent
Trollen

(10) Patent No.: US 11,613,410 B2
(45) Date of Patent: Mar. 28, 2023

(54) FLAT-BOTTOM GUSSETED BAG MADE FROM MULTI-LAYER SHEET

(71) Applicant: SONOCO DEVELOPMENT, INC., Hartsville, SC (US)

(72) Inventor: Jonathan Edward Trollen, Cincinnati, OH (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 0 days.

(21) Appl. No.: 17/543,187

(22) Filed: Dec. 6, 2021

(65) Prior Publication Data

US 2022/0089330 A1 Mar. 24, 2022

Related U.S. Application Data

(60) Division of application No. 15/947,419, filed on Apr. 6, 2018, now Pat. No. 11,225,360, which is a continuation of application No. 13/721,809, filed on Dec. 20, 2012, now Pat. No. 9,963,272.

(51) Int. Cl.

| | |
|---|---|
| ***B65D 33/02*** | (2006.01) |
| ***B65D 65/40*** | (2006.01) |
| ***B65D 75/00*** | (2006.01) |
| ***B65D 30/20*** | (2006.01) |
| ***B65D 75/58*** | (2006.01) |
| ***B65D 30/18*** | (2006.01) |
| ***B65D 33/16*** | (2006.01) |
| ***B65D 33/20*** | (2006.01) |

(52) U.S. Cl.

CPC ..... *B65D 33/02* (2013.01); *B65D 31/08* (2013.01); *B65D 31/10* (2013.01); *B65D 33/16* (2013.01); *B65D 33/20* (2013.01); *B65D 65/40* (2013.01); *B65D 75/008* (2013.01); *B65D 75/5838* (2013.01)

(58) Field of Classification Search

CPC ..... B65D 33/02; B65D 31/08; B65D 31/10; B65D 33/16; B65D 33/20; B65D 65/40; B65D 75/008; B65D 75/5838

USPC ..... 383/203

See application file for complete search history.

(56) References Cited

U.S. PATENT DOCUMENTS

| | | | |
|---|---|---|---|
| 3,074,544 | A | 1/1963 | Bollmeier et al. |
| 3,421,683 | A | 1/1969 | Fesco |
| 3,687,356 | A | 8/1972 | Goodrich et al. |
| 4,260,061 | A | 4/1981 | Jacobs |
| 5,314,252 | A | 5/1994 | Happ |
| 5,520,464 | A | 5/1996 | Kristola |
| 5,655,842 | A | 8/1997 | Hagino |

(Continued)

*Primary Examiner* — Peter N Helvey

(74) *Attorney, Agent, or Firm* — Nelson Mullins Riley & Scarborough LLP

(57) ABSTRACT

A flat-bottomed bag is formed from a flexible sheet that initially is flat prior to being manipulated to form the bag. The sheet is a laminate of a first web and a second web laminated together by an adhesive layer disposed between the webs. The sheet defines a plurality of serially connected side wall panels collectively defining a vertically extending side wall of the bag, and a plurality of bottom panels respectively connected to the side wall panels at respective fold lines. The bottom panels are folded about the fold lines and are attached together to form a flat bottom wall configured to support the bag in an upright orientation. The adhesive layer is in a partial-coverage pattern that includes adhesive-free regions located along each fold line between each bottom panel and the respective side wall panel connected therewith.

20 Claims, 9 Drawing Sheets

(56) References Cited

U.S. PATENT DOCUMENTS

| | | | |
|---|---|---|---|
| 5,753,895 | A | 5/1998 | Olson et al. |
| 5,871,790 | A | 2/1999 | Monier et al. |
| 5,928,554 | A | 7/1999 | Olson et al. |
| 6,049,072 | A | 4/2000 | Olson et al. |
| 6,206,570 | B1 | 3/2001 | Cortopassi |
| 6,265,038 | B1 | 7/2001 | Frisk |
| 6,396,036 | B1 | 5/2002 | Hanson |
| 6,489,022 | B1 | 12/2002 | Hamilton et al. |
| 6,517,243 | B2 | 2/2003 | Huffer et al. |
| 6,716,499 | B1 | 4/2004 | Vadhar |
| 7,858,909 | B2 | 12/2010 | Jackson et al. |
| 8,097,313 | B2 | 1/2012 | Wallat |
| 8,794,834 | B2 | 8/2014 | Forman |
| 2004/0005100 | A1 | 1/2004 | Versluys |
| 2004/0091648 | A1 | 5/2004 | Hartzell et al. |
| 2004/0096550 | A1 | 5/2004 | Schilmoeller et al. |
| 2004/0234174 | A1 | 11/2004 | Caudle |
| 2005/0276525 | A1 | 12/2005 | Hebert et al. |
| 2005/0284776 | A1 | 12/2005 | Kobayashi et al. |
| 2009/0232424 | A1 | 9/2009 | Bierschenk et al. |
| 2011/0117307 | A1 | 5/2011 | Fraser et al. |
| 2012/0014623 | A1 | 1/2012 | Bossel et al. |

FLAT-BOTTOM GUSSETED BAG MADE FROM MULTI-LAYER SHEET

CROSS-REFERENCE TO RELATED APPLICATIONS

This application is a divisional of U.S. patent application Ser. No. 15/947,419, filed Apr. 6, 2018, entitled "Flat-Bottom Gusseted Bag Made From Multi-Layer Sheet," which is a continuation of U.S. patent application Ser. No. 13/721,809, filed Dec. 20, 2012, now U.S. Pat. No. 9,963,272 entitled "Flat-Bottom Gusseted Bag Made From Multi-Layer Sheet," which are incorporated by reference herein in its entirety.

BACKGROUND OF THE INVENTION

The present disclosure relates in general to packages for lightweight bulk products such as snack crackers, chips, crisps, and the like. The disclosure relates more particularly to such packages in the form of a gusseted flat-bottomed bag configured to sit upright on a store shelf.

Effective displaying of bags of products such as potato chips, crackers, crisps, and the like, on a store shelf requires that the bags be maintained in an upright configuration so that the major surface of the front of each bag is presented for viewing by customers. Gusseted flat-bottomed bags are well-suited to such manner of display. Paper flat-bottomed bags tend to present no difficulty in stably standing on a shelf. When gusseted flat-bottomed bags are constructed of a polymer film-based material, however, the "memory" of the polymer film material tends to resist the requisite folding of the material that is needed in order for the bottom of the bag to flatten out and form a stable base for the upright bag. This is particularly true when polymer film materials of relatively high stiffness (e.g., laminates of multiple layers of polymer film) are employed.

BRIEF SUMMARY OF THE DISCLOSURE

The present disclosure describes the results of a development effort aimed at addressing and overcoming the above-noted technical challenge. In accordance with one embodiment of the invention, a flat-bottomed bag for sitting upright on a surface comprises a blank comprising a flexible sheet that initially is flat prior to being manipulated to form the bag, the sheet comprising a laminate of a first web and at least a second web, a face of the first web being affixed to an opposing face of the second web by an adhesive layer disposed between the first and second webs. The blank defines a plurality of serially connected side wall panels collectively defining a vertically extending side wall of the bag, and a plurality of bottom panels respectively connected to the side wall panels, each bottom panel being connected to a respective one of the side wall panels at a fold line. The bottom panels are folded about the fold lines to extend generally perpendicular relative to the side wall panels and are attached together to form a flat bottom wall configured to support the bag in an upright orientation.

The adhesive layer is in a partial-coverage pattern that includes adhesive-free regions located along each fold line between each bottom panel and the respective side wall panel connected therewith, such that areas of the blank in the adhesive-free regions along the fold lines have a lower stiffness than areas of the blank in which the first and second webs are affixed together by the adhesive.

This reduced stiffness along the fold lines means that less force is required to cause the bottom panels to fold into the necessary generally perpendicular orientation relative to the side wall panels to allow the bottom wall to form a stable support for the upright bag.

Bags having various configurations and features can be constructed in accordance with the present development. In one embodiment, the bag is configured to be folded into a collapsed generally flat state when empty, and then to be erected into an opened state for filling with product and sealing.

In some embodiments, the first web is formed principally of a first polymer material, and the second web is formed principally of a second polymer material. The first and second polymer materials can be chemically different.

In some embodiments, the bag can include a closure feature formed in the side wall of the bag. The closure feature can comprise a flap formed in the side wall by a generally U-shaped score line that extends through the thickness of the first web, which forms an outer surface of the bag, but does not extend through the second web, which forms an inner surface of the bag. Accordingly, the flap can be peeled away from the second web without breaching the side wall of the bag. The laminate includes a pressure-sensitive adhesive between the first and second webs in the area of the flap, such that the flap when peeled away from the second web has the pressure-sensitive adhesive on the flap. In use, after the top end of the bag has been opened in the usual fashion, the top end can be rolled down and the flap can be re-adhered to the rolled-down top end to hold the top end in the rolled-down configuration so as to reclose the bag.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

Figure 1:
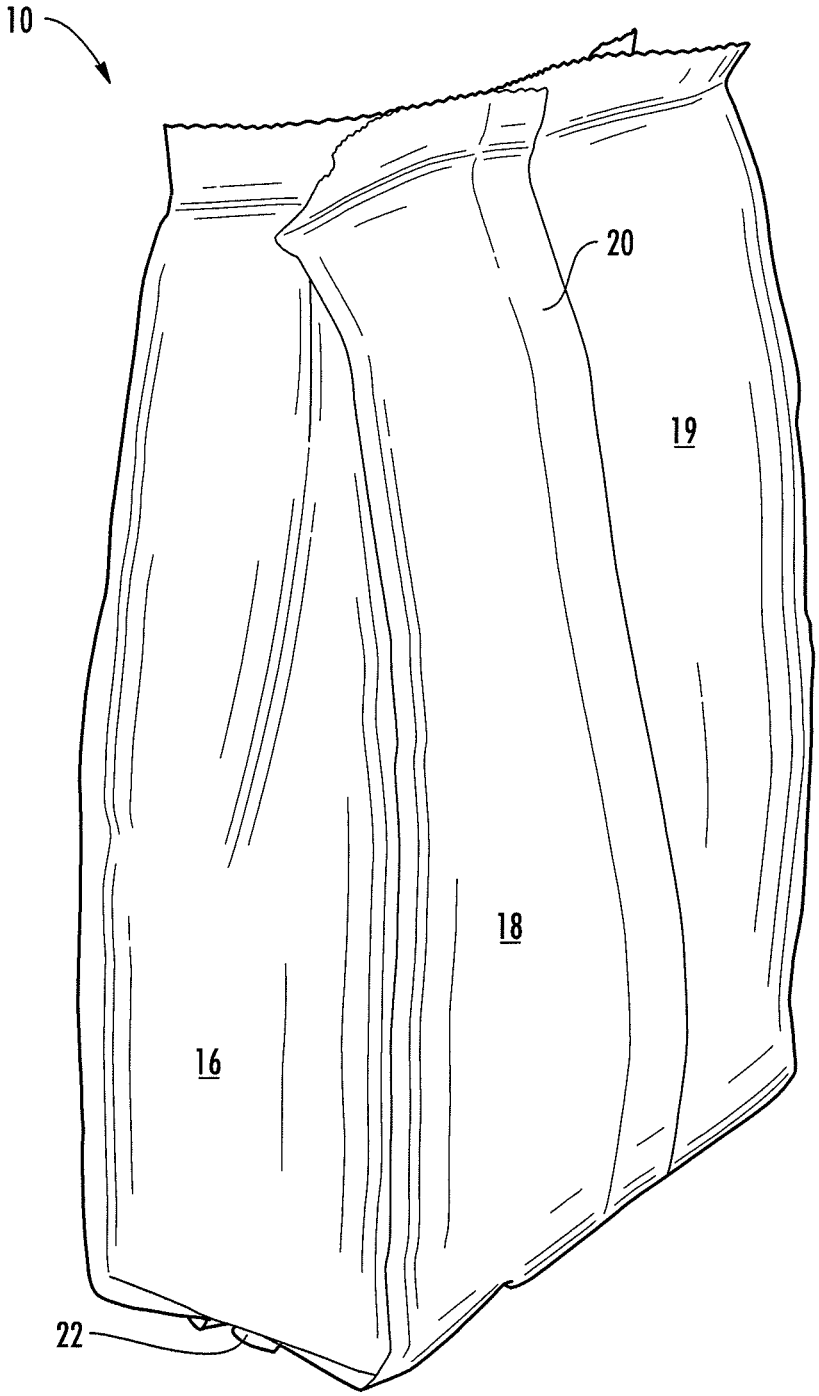
FIG. 1 is a perspective view of a gusseted flat-bottomed bag in accordance with an embodiment of the invention, viewed generally toward a rear side of the bag.
Figure 2:
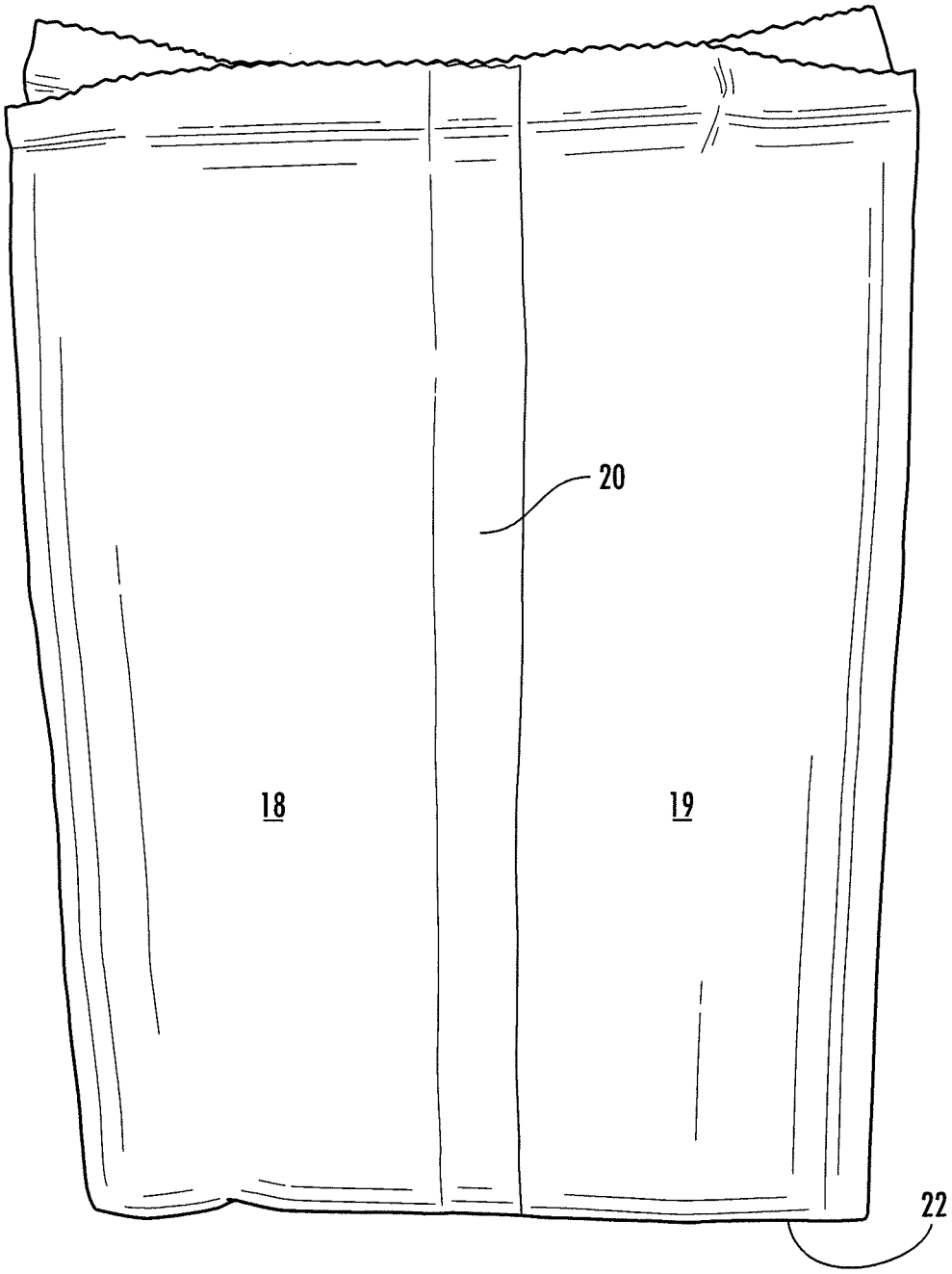
FIG. 2 is rear view of the bag.
Figure 3:
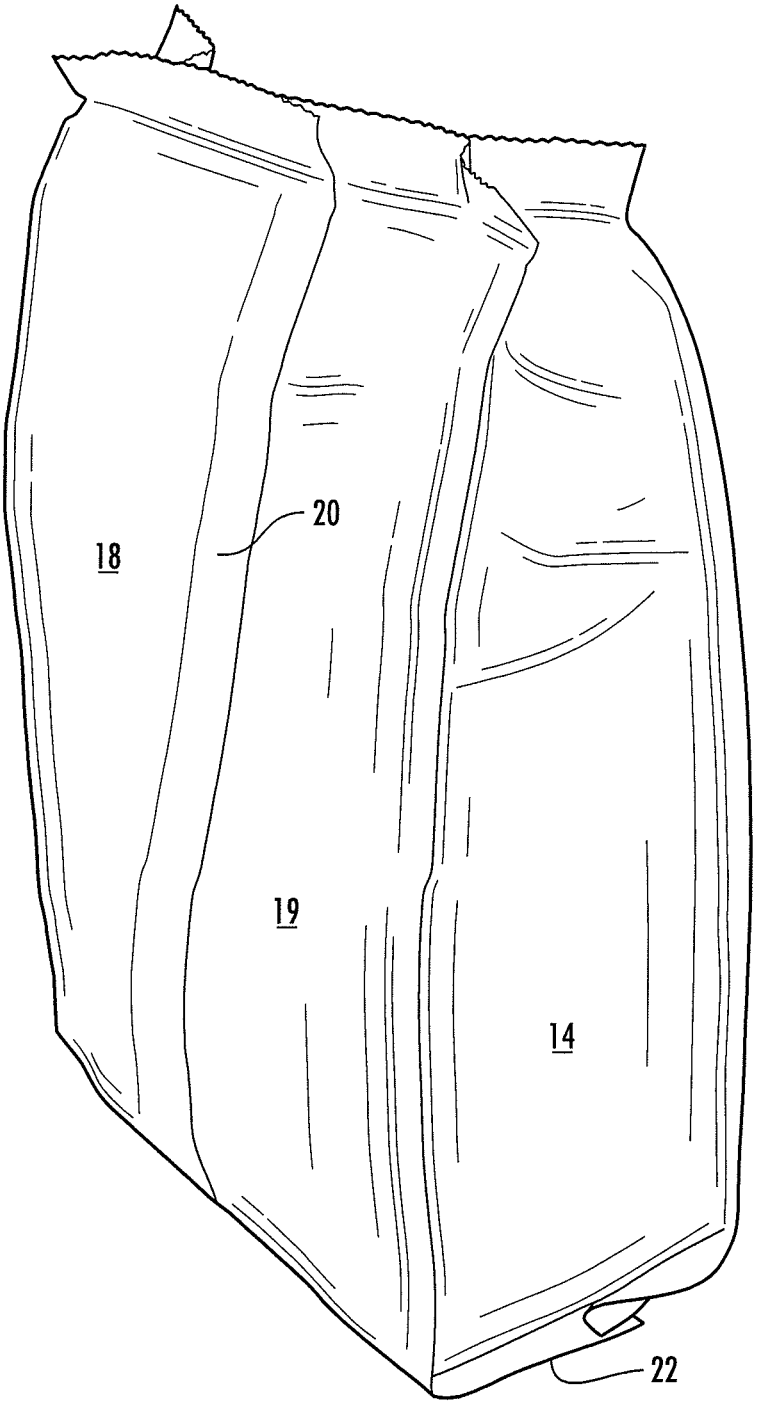
FIG. 3 is another perspective view of the bag as viewed generally toward the rear side.
Figure 4:
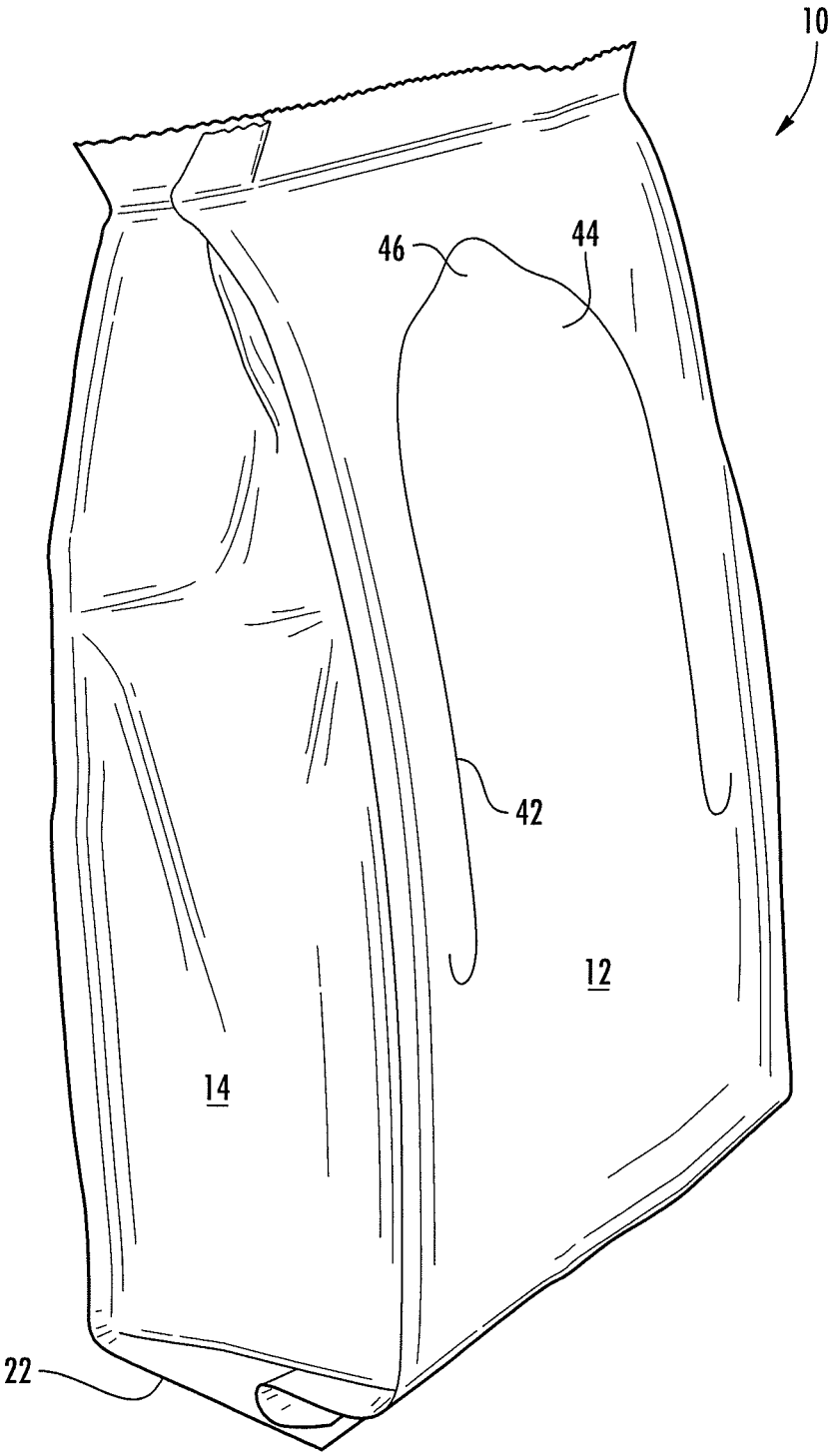
FIG. 4 is a perspective view of the bag as viewed generally toward a front side of the bag.
Figure 5:
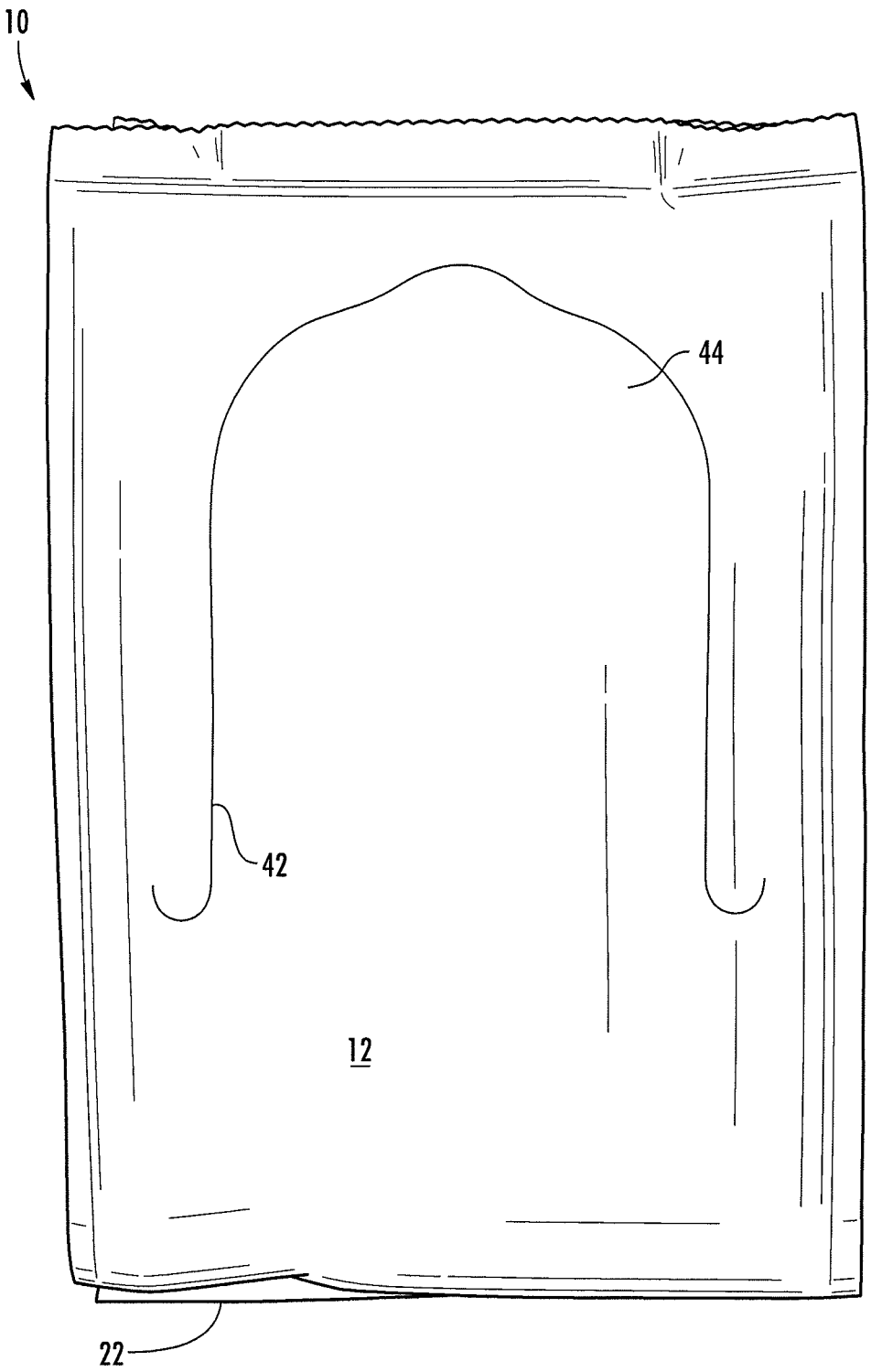
FIG. 5 is a front view of the bag.
Figure 6:
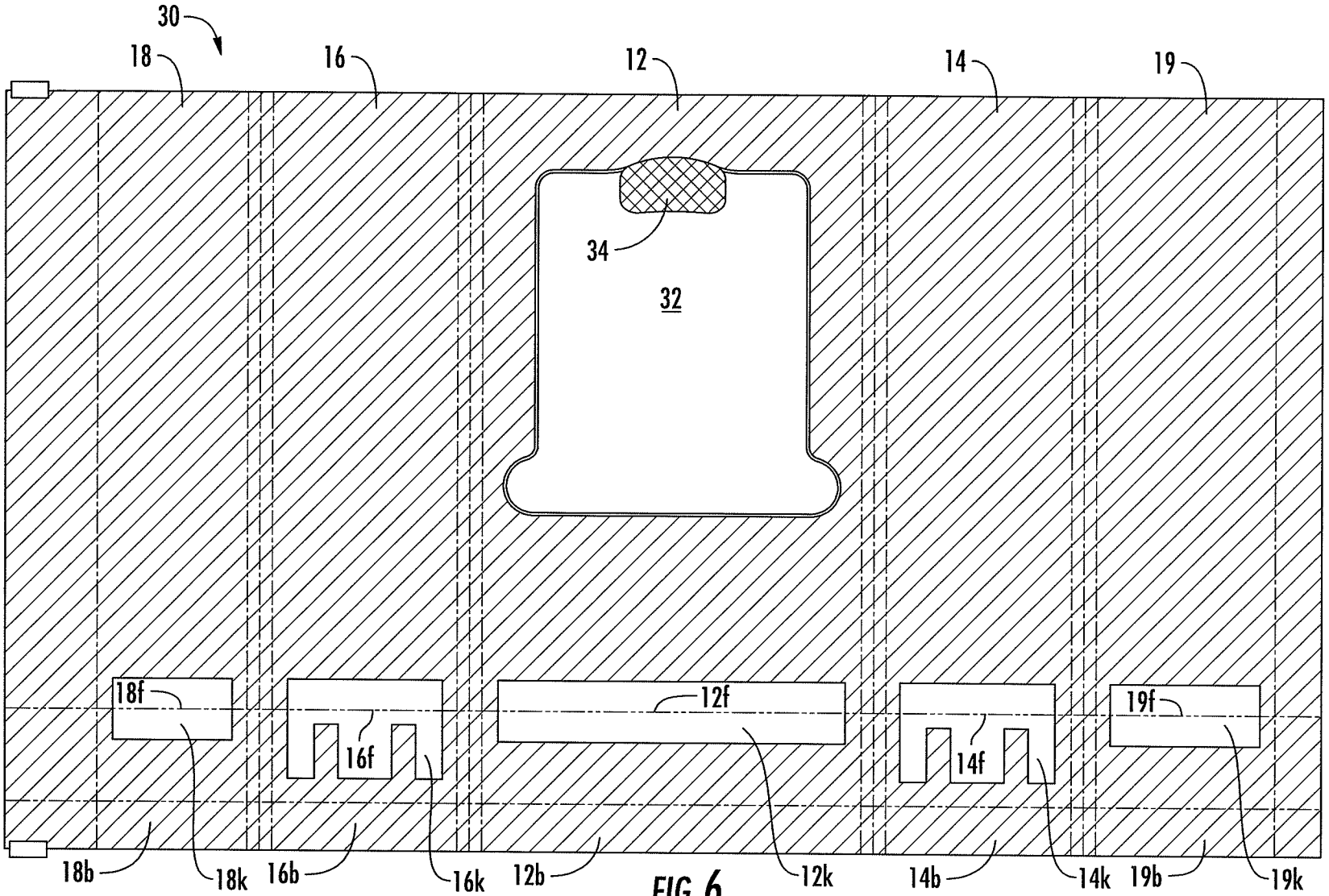
FIG. 6 is a plan view of one layer of the laminate from which the bag of FIGS. 1-5 is constructed, wherein single-hatching designates areas where laminating adhesive is present, double cross-hatching designates an area corresponding to the closure flap where no adhesive is present, and the rectangular areas with no hatching indicate "knock-out" areas where no adhesive is present.
Figure 7:
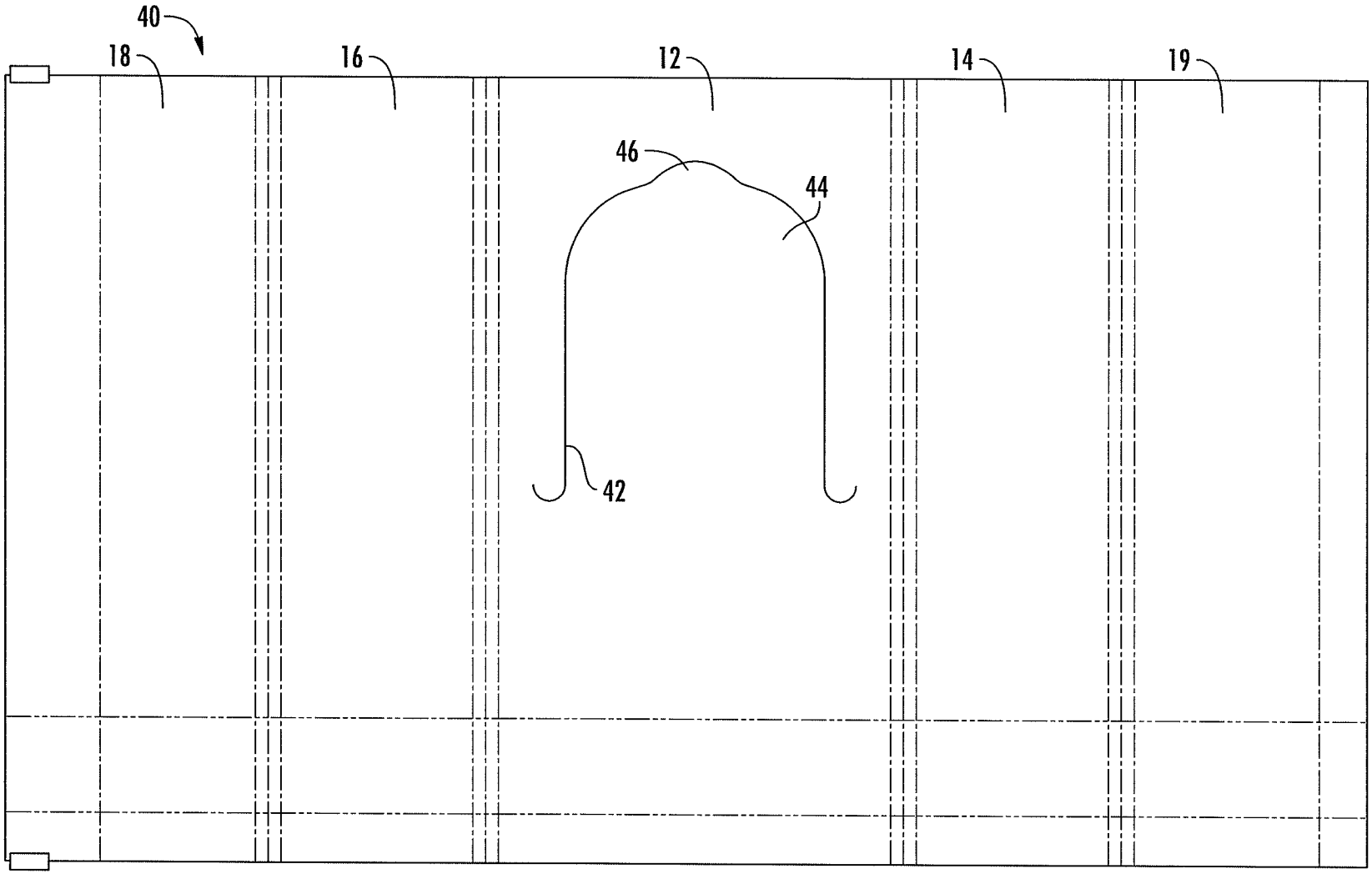
FIG. 7 is a plan view of the other layer of the laminate, showing the U-shaped score line that forms the closure flap, and wherein the dash-dot lines indicate fold lines where the ultimately formed laminate will be folded when the bag is formed.
Figure 8:
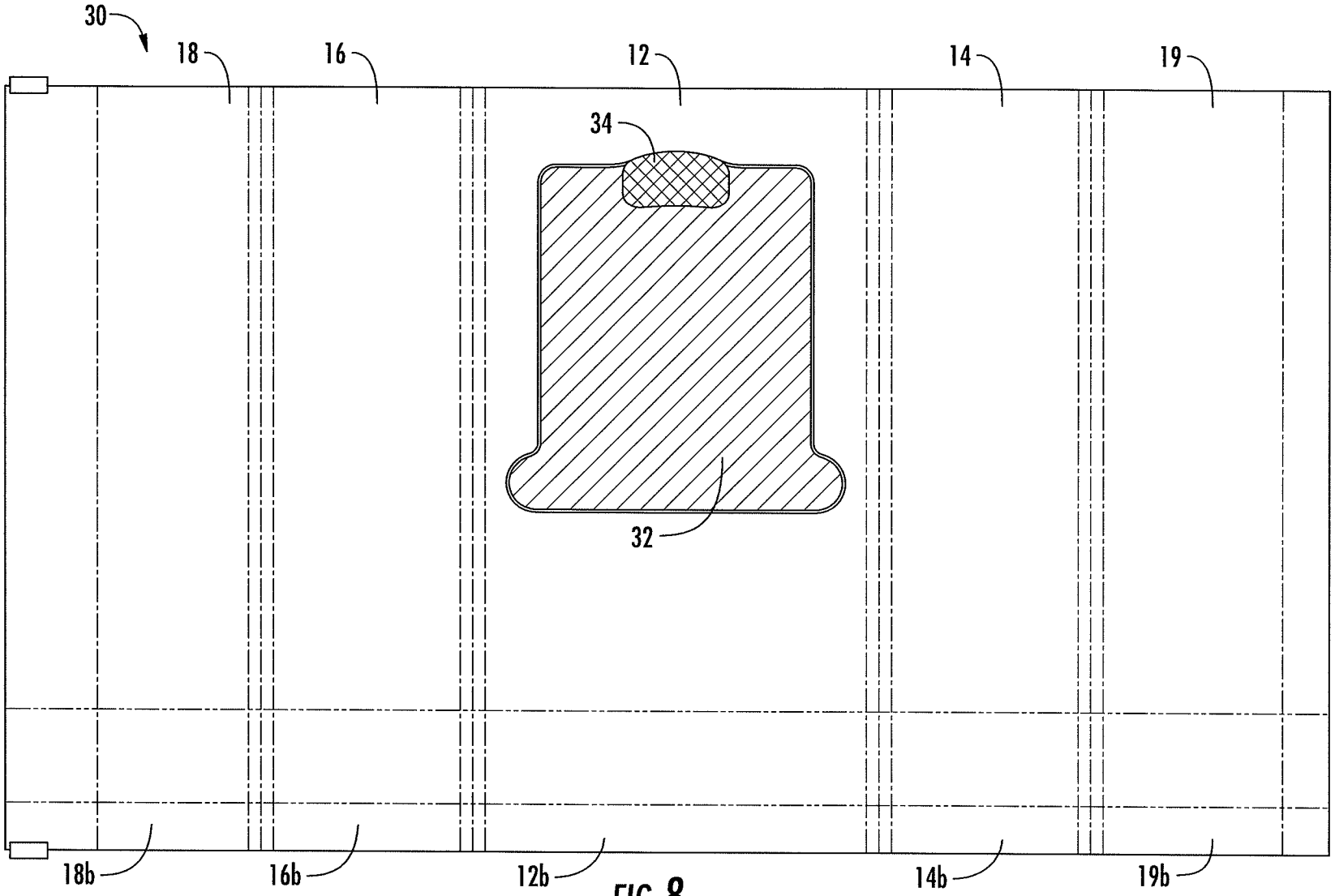
Figure 9:
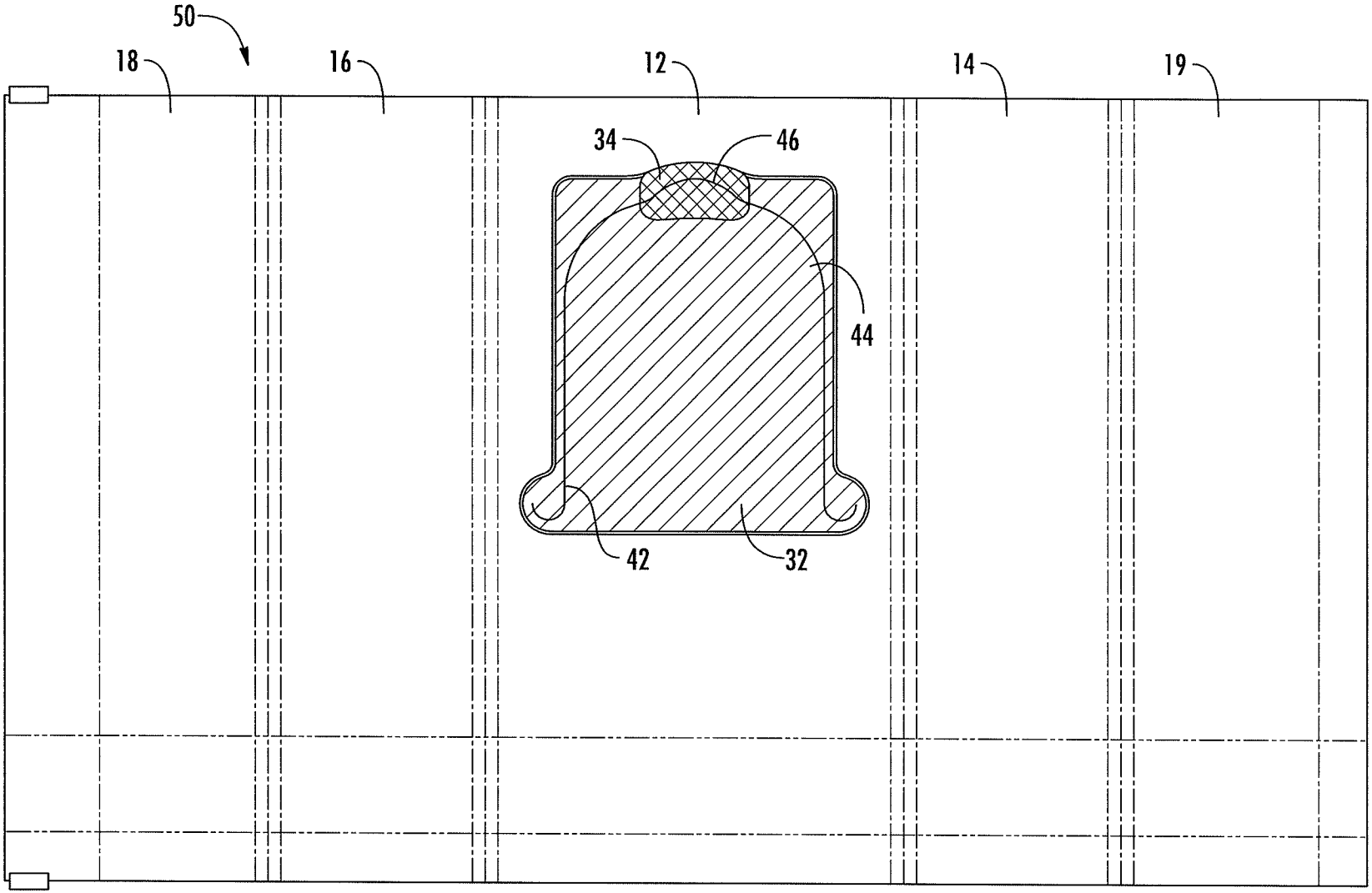

FIG. 8 is a plan view similar to FIG. 6, but wherein the single-hatching indicates where pressure-sensitive adhesive is present; and FIG. 9 is a plan view of the resulting laminate formed by laminating the one layer of FIGS. 6 and 8 to the other layer of FIG. 7, showing how the score line is registered relative to the pressure-sensitive adhesive area (single-hatching) and the adhesive-free area (double cross-hatching).

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

A gusseted flat-bottomed bag 10 in accordance with one embodiment of the invention is depicted in FIGS. 1-5, and details of the laminate from which the bag is constructed are shown in FIGS. 6-9. With reference to FIGS. 1-5, the bag 10 has a front panel 12 (FIGS. 4 and 5) constituting the major surface of the bag that is desired to be displayed to customers when the bag is on a store shelf. The front panel 12 generally would be printed with graphics and textual material illustrating and describing the contents of the bag and other information of interest to potential purchasers. The bag includes two opposite side panels 14 and 16 each of which has one vertically extending edge integrally connected to a corresponding vertically extending edge of the front panel 12 along a fold line therebetween. The bag also includes a pair of rear panels 18 and 19. The rear panel 18 has one vertically extending edge integrally connected to a corresponding vertically extending edge of the side panel 16 along a fold line therebetween. The rear panel 19 has one vertically extending edge integrally connected to a corresponding vertically extending edge of the side panel 14 along a fold line therebetween. The opposite edge portions of the two rear panels 18 and 19 (i.e., opposite from the edges connected to the side panels) are sealed together to form a longitudinally (i.e., vertically) extending fin 20. In the illustrated embodiment, the two rear panels 18 and 19 are approximately the same width (i.e., along the horizontal or left-to-right direction in FIG. 2) such that the fin 20 is located approximately centrally on the rear side of the bag with respect to the horizontal direction. This is not a necessity, however, and the bag can be constructed in other ways such that the fin is located closer to one edge than the other.

The bag also includes a bottom wall 22 that, as further described below in connection with FIGS. 6-9, is formed from a plurality of bottom panels that are respectively joined to the front panel 12, side panels 14 and 16, and rear panels 18 and 19.

Turning to FIG. 6, the inner web 30 of the laminate, from which the bag 10 is constructed, is depicted as a generally rectangular sheet. The inner web 30 will form the inner product-facing side of the laminate when it is formed into the bag. The inner web 30 includes the front panel 12 and a corresponding bottom panel 12*b* integrally connected to a horizontally extending bottom edge of the front panel 12 along a fold line 12*f* therebetween. The inner web 30 includes the side panel 14 and a bottom panel 14*b* integrally connected to a horizontally extending bottom edge of the side panel 14 along a fold line 14*f* therebetween, and includes the side panel 16 and a bottom panel 16*b* integrally connected to a horizontally extending bottom edge of the side panel 16 along a fold line 16*f* therebetween. The inner web 30 also includes the rear panel 18 and a bottom panel 18*b* integrally connected to a horizontally extending bottom edge of the rear panel 18 along a fold line 18*f* therebetween, and includes the rear panel 19 and a bottom panel 19*b* integrally connected to a horizontally extending bottom edge of the rear panel 19 along a fold line 19*f* therebetween. The fold lines 12*f* through 19*f* are collinear.

With further reference to FIG. 6 and additional reference to FIG. 8 showing a further view of the inner web 30, a laminating adhesive is pattern-applied onto the region of the inner web 30 (or, alternatively, onto a corresponding region of the other web that is laminated to the inner web) designated by the single-hatching in FIG. 6. The region 32 is free of laminating adhesive (indicated by the absence of single-hatching in FIG. 6) but has a pressure-sensitive adhesive (indicated by the single-hatching in FIG. 8). The region 34 designated by double cross-hatching in FIGS. 6 and 8 is an adhesive-free region that has neither laminating adhesive nor pressure-sensitive adhesive. The dash-dot lines in FIGS. 6 and 8 indicate fold lines between the respective contiguous panels, where the laminate is folded to construct the bag.

As shown in FIG. 6, there are "knock-out" areas 12*k*, 14*k*, 16*k*, 18*k*, and 19*k* each of which straddles the respective fold line 12*f*, 14*f*, 16*f*, 18*f*, or 19*f* between the corresponding bottom panel 12*b*, 14*b*, 16*b*, 18*b*, or 19*b* and the front/side/rear panel to which the bottom panel is connected. The "knock-out" areas are free of adhesive. Thus, when the inner web 30 is joined to the outer web 40 (FIG. 7) to form the laminate 50 (FIG. 9), the two webs are not adhered together in the "knock-out" areas 12*k*, 14*k*, 16*k*, 18*k*, and 19*k*. The fold lines thus are located in the "knock-out" areas.

With reference to FIG. 7, the outer web 40 is depicted. In the front panel 12 of the outer web, a U-shaped score line 42 is formed. The score line 42 extends partially or completely through the thickness of the outer web 40 so as to define a flap 44 that can be lifted out of the plane of the front panel 12. As indicated in FIG. 9 showing the laminate 50 formed by laminating the inner web 30 to the outer web 40 via the laminating and pressure-sensitive adhesives, the score line 42 is located so that it is entirely contained within the pressure-sensitive adhesive region 32. The flap 44 has a hinge line, extending between the two ends of the U-shaped score line, by which the flap is connected to the remainder of the outer web 40. The opposite end of the flap from the hinge line defines a tab portion 46 that is located in the adhesive-free region 34. This allows the user to grasp the tab portion 46 and peel the flap 44 back from the underlying inner web 30. The pressure-sensitive adhesive remains attached to the flap 44 when the flap is peeled back, and thus the flap can be used as a closure for reclosing the top end of the bag after the initial opening. More particularly, the open top end is rolled down and the adhesive flap 44 is adhered to the rolled-down top to hold it in the rolled-down condition.

In the appended claims, the front panel, rear panels, and side panels are sometimes alternately referred to as all being "side wall panels" in the sense that the bag 10 has a vertically extending side wall that is formed by these serially connected side wall panels (i.e., the rear panel or side wall panel 18 is connected to the side panel or side wall panel 16, which is connected to the front panel or side wall panel 12, which is connected to the side panel or side wall panel 14, which is connected to the rear panel or side wall panel 19).

The laminate 50 can be formed into a bag 10 on a vertical form-fill-seal machine. A continuous web of the laminate is unwound from a roll on an unwind stand and is passed through a series of idler rollers, and into a bag-forming section. The bag former first makes a seamed rectangular tube in the machine (running) direction, and then makes a cross heat seal on the bottom of the bag. A product weighing scale then drops the product into the bottom of the bag and the product rests on the sealed bottom of the bag. The top heat seal is then made, completely sealing up the bag, and the bag is severed from the remainder of the web.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of forming a blank to be formed into flat-bottomed bag, the method comprising:
- providing a first web and a second web;
- pattern applying an adhesive to an adhesive-region of the first web;
- laminating the first web to the second web via the adhesive;
- forming a blank from the laminate, the blank defining:
  - a front panel;
  - a left side panel joined to a left side edge of the front panel;
  - a right side panel joined to a right side edge of the front panel;
  - a pair of partial rear panels respectively joined to each of the left and right side panels;
  - a plurality of bottom panels respectively joined to lower edges of the front, left side, right side, and rear panels; and
  - fold lines respectively formed at each juncture between said panels;
- wherein the pattern applied adhesive is not applied to a plurality of adhesive-free fold line regions,
- wherein each adhesive-free fold line region: extends substantially along the length of a fold line, between a bottom panel and the single respective front, left side, right side, or rear panels joined therewith,
  - without covering a juncture between any of the following panels:
    - the front panel,
    - the left side panel,
    - the right side panel, and
    - the rear panels, and
- extends at least partially above and below each fold line.

2. The method of claim 1, further comprising:
- sealing the pair of partial rear panels together creating a seamed rectangular tube.

3. The method of claim 2, further comprising:
- sealing a bottom portion of each of the plurality of bottom panels together, defining a bag with an open top side.

4. The method of claim 3, further comprising:
- adding a product through the open top side; and
- heat sealing a top portion of the front panel, a top portion of the left side panel, a top portion of the right side panel and a top portion of the pair of partial rear panels together thereby sealing the open top side of the bag.

5. The method of claim 3, wherein the sealing is completed on a vertical form-fill-seal machine.

6. The method of claim 1, further comprising:
- printing the front panel with graphics.

7. The method of claim 1, wherein the adhesive is a permanent adhesive.

8. The method of claim 1, wherein the adhesive is a pressure sensitive adhesive.

9. The method of claim 1, wherein the adhesive-free fold line regions are generally centered about the respective fold line.

10. The method of claim 1, further comprising:
- forming at least one closure feature in one of the front panel, the right side panel, the left side panel, or the rear panel.

11. The method of claim 1, further comprising:
- severing the formed bag from the laminate.

12. A method of forming a bag, the method comprising:
- providing a first web and a second web;
- pattern applying an adhesive to an adhesive-region of the first web;
- laminating the first web to the second web via the adhesive;
- forming a blank from the laminate, the blank defining:
  - a front panel;
  - a left side panel joined to a left side edge of the front panel;
  - a right side panel joined to a right side edge of the front panel;
  - a rear panel joined to one of the left side panel or right side panels;
  - a plurality of bottom panels respectively joined to lower edges of the front panel, left side, right side, and rear panel; and
  - fold lines respectively formed at each juncture between the panels;
- wherein the pattern applied adhesive is not applied to a plurality of adhesive-free fold line regions,
- wherein each adhesive-free fold line region: extends substantially along the length of a fold line, between a bottom panel and the single respective front, left side, right side, or rear panel joined therewith,
  - without covering a juncture between any of the following panels:
    - the front panel,
    - the left side panel,
    - the right side panel, and
    - the rear panel, and
  - extends at least partially above and below each fold line;
- sealing the rear panel to the unattached left side panel or the right side panel;
- sealing a bottom portion of each of the plurality of bottom panels together, defining a bag with an open top side.

13. The method of claim 12, further comprising:
- filling the bag with a product through the open top side;
- heat sealing a top portion of the front panel, a top portion of the left side panel, a top portion of the right side panel and a top portion of the rear panel together thereby sealing the open top side of the bag.

14. The method of claim 12, wherein the sealing is completed on a vertical form-fill-seal machine.

15. A method of forming a bag, the method comprising:
- providing a series of blanks having a first web laminated to a second web by an adhesive, each of the blanks comprising:
  - a plurality of serially connected side wall panels; and
  - a plurality of bottom panels respectively connected to the plurality of side wall panels, each of the plurality of bottom panels being connected to a respective one of the plurality of side wall panels at a fold line;

wherein the adhesive is a patterned adhesive defining a plurality of adhesive-free fold line regions, wherein each adhesive-free fold line region:

extends substantially along the length of a fold line, between a bottom panel and the single respective front, left side, right side, or rear panel joined therewith, and extends at least partially above and below each fold line; and wherein the at least one adhesive region is disposed on at least one juncture between any of the following panels:

the front panel, the left side panel, the right side panel, and the rear panel;

sealing the rear panel to either the left side panel or the right side panel; and sealing a bottom portion of each of the plurality of bottom panels together, defining a bag with an open top.

16. The method of claim 15, further comprising:

filling the bag with a product through the open top; and heat sealing a top portion of each of the plurality of serially connected side wall panels to one another.

17. The method of claim 16, further comprising:

severing the sealed bag from the series of blanks.

18. The method of claim 15, wherein one of the sidewall panels comprises:

at least one score line disposed at least partially through the thickness the first web.

19. The method of claim 18, wherein the at least one score lines defines a flap within the first web.

20. The method of claim 15, wherein the bottom seal is a cross heat seal.

* * * * *